US012435943B2

(12) United States Patent
Lee

(10) Patent No.: US 12,435,943 B2
(45) Date of Patent: Oct. 7, 2025

(54) BULLPUP-TYPE GUN WITH BARREL POSITIONED AT BOTTOM

(71) Applicant: Seong Won Lee, Pyeongtaek-si (KR)

(72) Inventor: Seong Won Lee, Pyeongtaek-si (KR)

( * ) Notice: Subject to any disclaimer, the term of this patent is extended or adjusted under 35 U.S.C. 154(b) by 0 days.

(21) Appl. No.: 18/922,736

(22) Filed: Oct. 22, 2024

(65) Prior Publication Data

US 2025/0130006 A1 Apr. 24, 2025

(30) Foreign Application Priority Data

Oct. 23, 2023 (KR) ..... 10-2023-0141869

(51) Int. Cl.
*F41A 35/00* (2006.01)
*F41G 1/033* (2006.01)
*F41G 1/16* (2006.01)

(52) U.S. Cl.
CPC ..... *F41A 35/00* (2013.01); *F41G 1/033* (2013.01); *F41G 1/16* (2013.01)

(58) Field of Classification Search
CPC ..... F41A 35/00
See application file for complete search history.

(56) References Cited

U.S. PATENT DOCUMENTS

| | | | |
|---|---|---|---|
| 4,513,523 | A | 4/1985 | Gal |
| 2015/0107143 | A1 | 4/2015 | Coetzee et al. |
| 2019/0137207 | A1 | 5/2019 | Patrick, IV |

FOREIGN PATENT DOCUMENTS

KR 10-2016-0086105 A 7/2016

*Primary Examiner* — Reginald S Tillman, Jr.
(74) *Attorney, Agent, or Firm* — Studebaker Brackett PLLC

(57) ABSTRACT

The present invention relates to a bullpup-type gun with a barrel positioned at the bottom, in which the bullpup-type gun basically has a bullpup-type shape, and a barrel, a loading handle, and a shell discharge part are provided at a lower side of a body part, which may prevent burns and injuries to a user caused by a configuration in which a shell is discharged upward, and a height difference between a front sight and a rear sight may solve a problem with an aiming degree caused by a configuration in which the barrel is disposed at the bottom.

5 Claims, 9 Drawing Sheets

FOLDED
BUTTSTOCK

UNFOLDED
BUTTSTOCK

BULLPUP-TYPE GUN WITH BARREL POSITIONED AT BOTTOM

CROSS-REFERENCE TO RELATED APPLICATION

This application claims priority to and the benefit of Korean Patent Application No. 10-2023-0141869 filed in the Korean Intellectual Property Office on Oct. 23, 2023, the entire contents of which are incorporated herein by reference.

TECHNICAL FIELD

The present invention relates to a bullpup-type gun with a barrel positioned at the bottom, and more particularly, to a bullpup-type gun with a barrel positioned at the bottom, in which the bullpup-type gun basically has a bullpup-type shape, and a barrel, a loading handle, and a shell discharge part are provided at a lower side of a body part, which may prevent burns and injuries to a user caused by a configuration in which a shell is discharged upward, and a height difference between a front sight and a rear sight may solve a problem with an aiming degree caused by a configuration in which the barrel is disposed at the bottom.

BACKGROUND ART

In general, a bullpup-type gun refers to a firearm having a mechanism part (operating part) positioned rearward of a trigger. Because the bullpup-type gun has a barrel having a length longer than an overall length, the mechanism part includes a position at which a buttstock is positioned, and a barrel length may be ensured to that extent in comparison with a rifle with the same length. Therefore, the bullpup-type gun may have advantages in that muzzle flame is less, a bullet velocity is high, and the bullpup-type gun is easy to carry and store, in comparison with a gun with a similar length.

In addition, during long-range shooting, the barrel with a long length increases an acceleration length of a bullet, resulting in a higher bullet velocity and a straighter bullet trajectory, which makes it easy to perform long-range shooting and increases the power of the bullet in comparison with a rifle with the same length.

However, because of the gun design, a center of gravity of the gun is biased rearward, and a front side of the gun is light in weight, which may cause muzzle lifting such as a sudden rise of the muzzle caused by a counteraction. Further, because a shell discharge part is directed toward a user's body, there is a concern that the user is struck by a loading handle or a shell, which causes burns or injuries.

In particular, because a shell, which is discharged after a bullet is fired, is very hot, the user's face may be burned in case that the discharged shell is bounced toward the user's face. Further, because the loading handle may hit the user's face, the user needs to be careful when using the gun.

SUMMARY

The present invention has been made in an effort to solve the above-mentioned problem, and an object of the present invention is to provide a bullpup-type gun with a barrel positioned at the bottom, in which the bullpup-type gun basically has a bullpup-type shape, and a barrel, a loading handle, and a shell discharge part are provided at a lower side of a body part, which may prevent burns and injuries to a user caused by a configuration in which a shell is discharged upward, and a height difference between a front sight and a rear sight may solve a problem with an aiming degree caused by a configuration in which the barrel is disposed at the bottom.

A bullpup-type gun 100 with a barrel positioned at the bottom according to an embodiment of the present invention may include: a bullpup-type body part 110 including a trigger handle 111 and a trigger 112; a Picatinny rail 120 provided at an upper tip of the bullpup-type body part 110 and having a predetermined length defined forward; a barrel 130 provided at a lower tip of the bullpup-type body part 110 and directed forward; a support handle 140 configured to connect a lower side of a tip of the Picatinny rail 120 and an upper side of a tip of the barrel 130; a magazine 150 inserted and mounted into a rear end of the bullpup-type body part 110 vertically; a shell reflection plate 160 provided on a lateral surface of the bullpup-type body part 110 in a downward direction and configured to prevent a shell, which is discharged downward from the bullpup-type body part 110 after firing, from being bounced upward; and a loading handle 170 disposed below the bullpup-type body part 110 and disposed at the same horizontal position as the barrel 130.

In the embodiment, a buttstock 113 may be provided at a rear end of the bullpup-type body part 110 and unfolded or folded by being rotated from the bullpup-type body part 110 in an upward/downward direction by means of a hinge.

In the embodiment, a reinforcement iron core 121 corresponding to a length of the Picatinny rail 120 may be provided inside the Picatinny rail 120.

In the embodiment, a front sight 180 may be fitted with a tip of the Picatinny rail 120 in a direction from above to below, and a rear sight 190 may be provided on an upper portion of the trigger handle 111 and has a height difference from the front sight 180.

In the embodiment, the front sight 180 and rear sight 190 may be rotated in a hinged manner so that angles thereof are adjusted.

According to one aspect of the present invention, the bullpup-type gun basically has the bullpup-type shape, and the barrel, the loading handle, and the shell discharge part are provided at the lower side of the body part, which may prevent burns and injuries to the user caused by the configuration in which a shell is discharged upward.

In addition, according to one aspect of the present invention, the height difference between the front sight and the rear sight may solve the problem with the aiming degree caused by the configuration in which the barrel is disposed at the bottom.

In addition, various structures, such as the angle handle or the grenade launcher, may be attached and used by using the Picatinny rail.

DETAILED DESCRIPTION

Hereinafter, exemplary embodiments are proposed to help understand the present invention. However, the following embodiments are provided just for more easily understanding the present invention, and the contents of the present invention are not limited by the embodiments.

Figure 1:
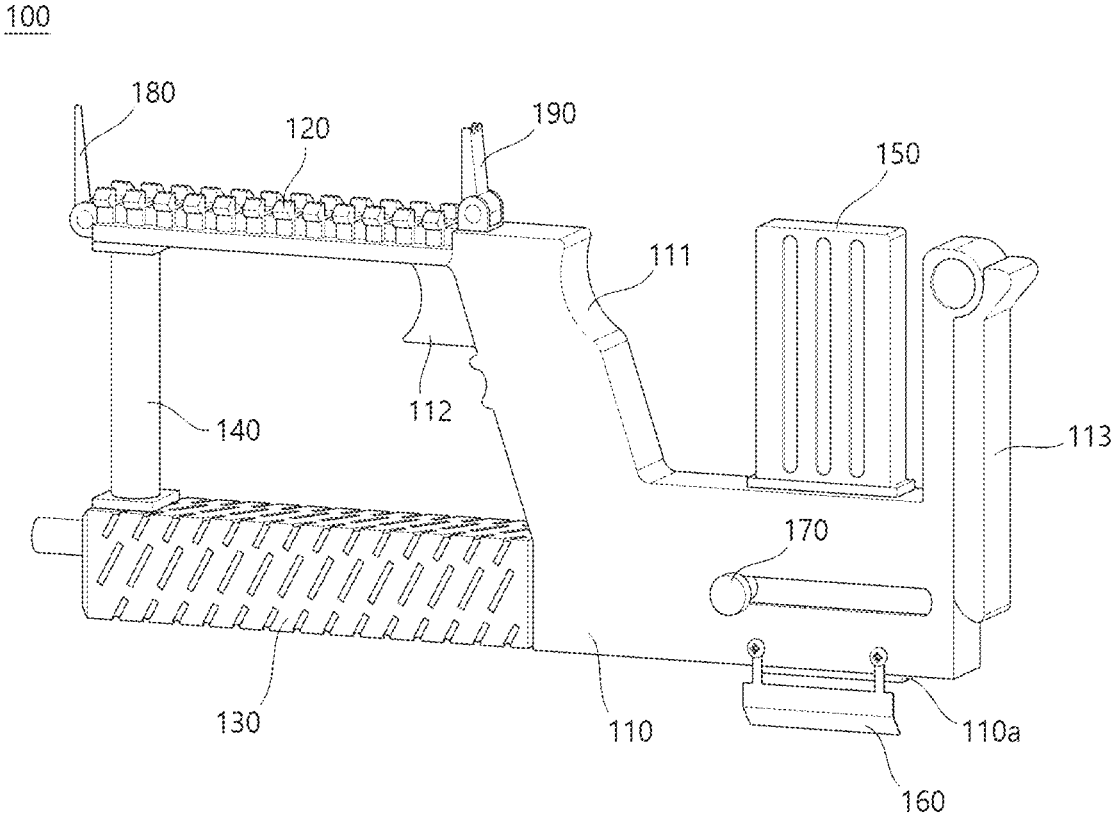
FIG. 1 is a view illustrating shape of a an overall bullpup-type gun 100 with a barrel positioned at the bottom according to an embodiment of the present invention.
Figure 2:
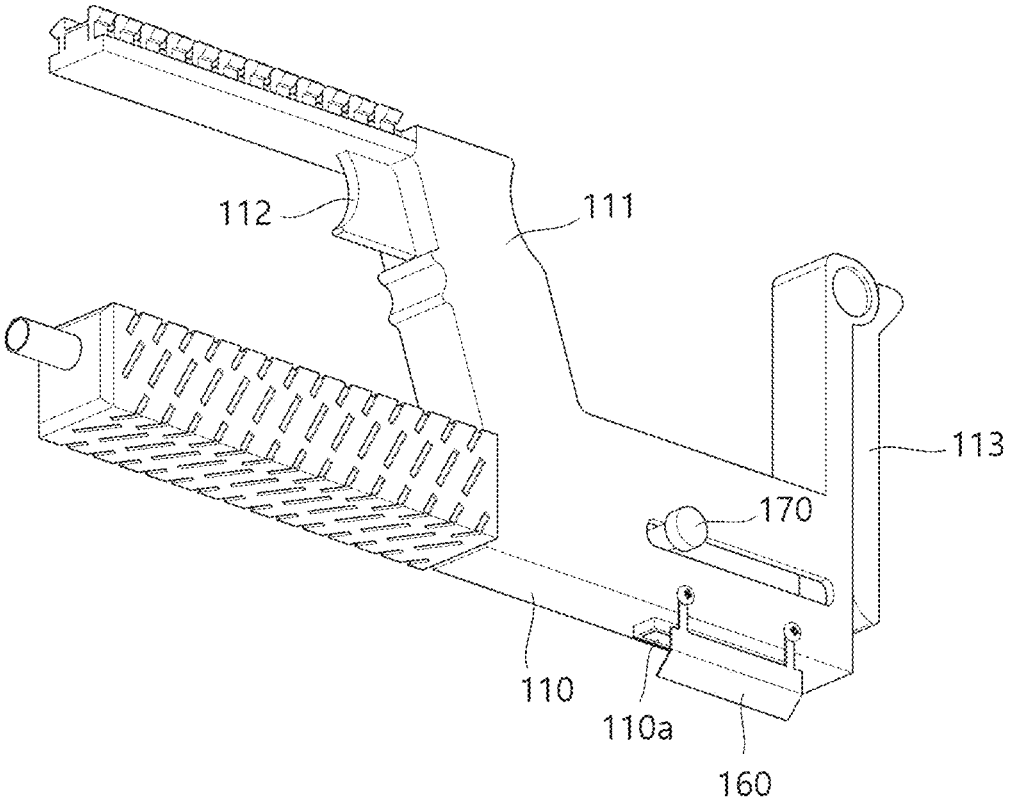
FIG. 2 is a view more specifically illustrating the bullpup-type body part 110.
Figure 3:
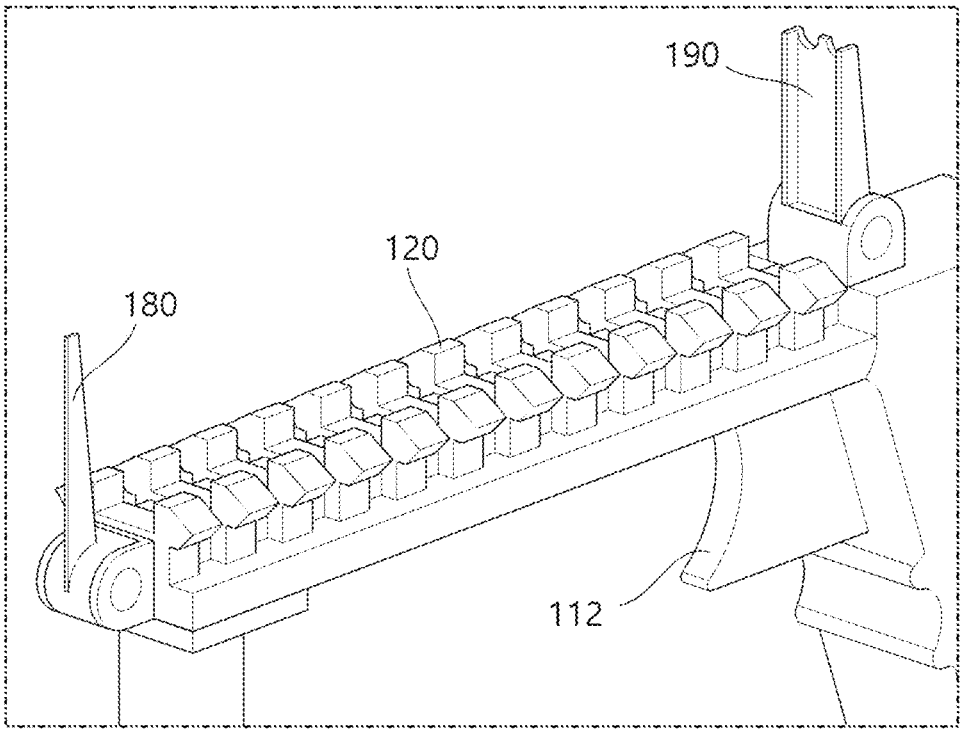
FIG. 3 is a view more specifically illustrating a Picatinny rail 120.

FIG. 1 is a view illustrating an overall shape of a bullpup-type gun 100 with a barrel positioned at the bottom according to an embodiment of the present invention, FIG. 2 is a view more specifically illustrating the bullpup-type body part 110, and FIG. 3 is a view more specifically illustrating a Picatinny rail 120.

With reference to FIGS. 1 to 3, the bullpup-type gun 100 with a barrel positioned at the bottom according to the embodiment of the present invention broadly includes a bullpup-type body part 110, the Picatinny rail 120, a barrel 130, a support handle 140, a magazine 150, a shell reflection plate 160, a loading handle 170, a front sight 180, and a rear sight 190.

First, the bullpup-type body part 110 basically has a structure in which a mechanism part (operating part) is positioned at a rear end of a trigger 112. That is, a general gun has a structure in which the barrel 130 and the mechanism part (operating part) connected to the barrel 130 are positioned to be closer to a front end than the trigger 112. In contrast, in the present invention, the gun has a bullpup-type structure in which the loading handle 170 is positioned to be closer to a rear end than a trigger handle 111 and the trigger 112.

A Picatinny rail 120 is provided at an upper tip of the bullpup-type body part 110 and having a predetermined length defined forward.

A publicly-known technology in the related art may be applied to a structure of the Picatinny rail 120. However, in the present invention, various structures, such as an angle handle or a grenade launcher may be installed and used in accordance with a length of the Picatinny rail 120. This configuration will be described below.

In addition, a horizontal region is formed at a rear end of the trigger handle 111 of the bullpup-type body part 110, and the magazine 150 is inserted and mounted into the corresponding horizontal region from above to below in a vertical direction, such that the magazine 150 is loaded. The loading handle 170 is positioned below the magazine 150. In this case, because a height of the loading handle 170 is positioned below the front sight 180 and the rear sight 190 that will be described below, the user is not injured by a collision with the loading handle during a firing process.

In addition, a buttstock 113 is provided at a rear end of the bullpup-type body part 110. The buttstock 113 is unfolded or folded by being rotated in an upward/downward direction from the bullpup-type body part 110 by means of a hinge. This configuration will be described below.

Figure 4A:
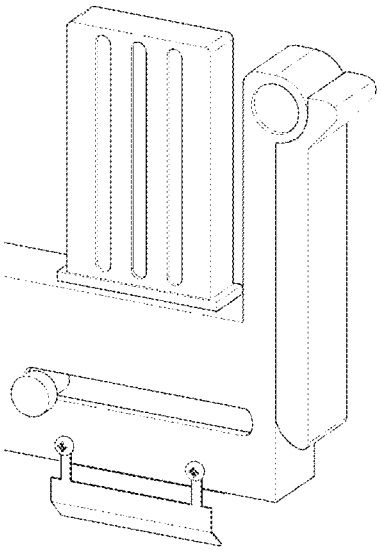
FIGS. 4A and 4B are views illustrating a state in which a buttstock 113 is rotated from the bullpup-type body part 110 by means of a hinge.
Figure 4B:
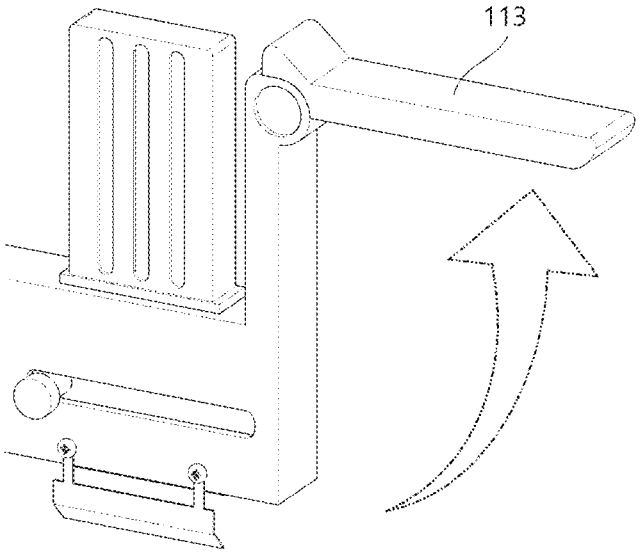

FIGS. 4A and 4B are views illustrating a state in which the buttstock 113 is rotated from the bullpup-type body part 110 by means of the hinge.

With reference to FIGS. 4A and 4B, one side of the buttstock 113 is hingedly coupled to the bullpup-type body part 110. At ordinary times, as illustrated in FIG. 4A, the buttstock 113 is kept maximally tightly attached to the bullpup-type body part 110. The user may, as necessary, rotate the buttstock 113 upward and use the buttstock 113.

In addition, a shell discharge part 110*a* is provided at a lower side of the bullpup-type body part 110, and a shell is discharged downward from the shell discharge part 110*a* after firing. This configuration will be described below.

Figure 5:
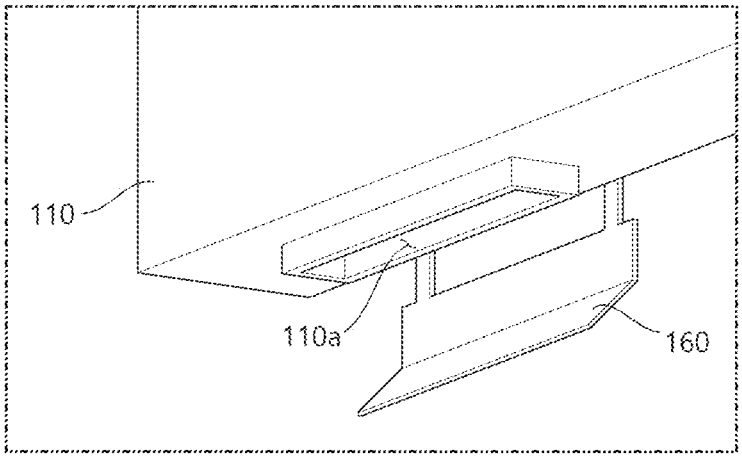
FIG. 5 is a view more specifically illustrating a shell discharge port 110*a* of the bullpup-type body part 110 and a shell reflection plate 160 installed adjacent to the shell discharge port 110*a* and configured to prevent a shell from being bounced upward.

FIG. 5 is a view more specifically illustrating the shell discharge port 110*a* of the bullpup-type body part 110 and the shell reflection plate 160 installed adjacent to the shell discharge port 110*a* and configured to prevent a shell from being bounced upward.

With reference to FIG. 5, a shell discharge port 110*a* may be formed in a lower surface of the bullpup-type body part 110 according to the present invention instead of a lateral surface of the bullpup-type body part 110, unlike a gun structure in the related art. Therefore, a high-temperature shell strongly discharged after firing may be discharged while naturally falling downward by gravity without being bounced toward the user's face or body, such that the user is not burnt or injured.

In addition, additionally, in the present invention, the shell reflection plate 160 is additionally installed at a position adjacent to the shell discharge port 110*a*. The shell reflection plate 160 is installed on a lateral surface of the bullpup-type body part 110 and serves as a guide that prevents a shell discharged through the shell discharge port 110*a* after firing from being bounced laterally and prevents the shell from scattering in all directions. The shell reflection plate 160 may be separated from the bullpup-type body part 110, as necessary, by releasing a bolt.

Meanwhile, the barrel 130 is provided at a lower tip of the bullpup-type body part 110 and directed forward. In this case, the support handle 140 may be provided in the vertical direction between the Picatinny rail 120 and the barrel 130 that have been described above. When the user uses the gun, the support handle 140 may be used to improve gripping stability and firing stability by allowing the user to grip the trigger handle 111 with one hand and grip the support handle 140 with the other hand. The support handle 140 may be separated from the bullpup-type body part 110, as necessary.

Meanwhile, in the embodiment, a reinforcement iron core corresponding to a length of the Picatinny rail 120 may be provided inside the Picatinny rail 120. This configuration will be described below.

Figure 6:
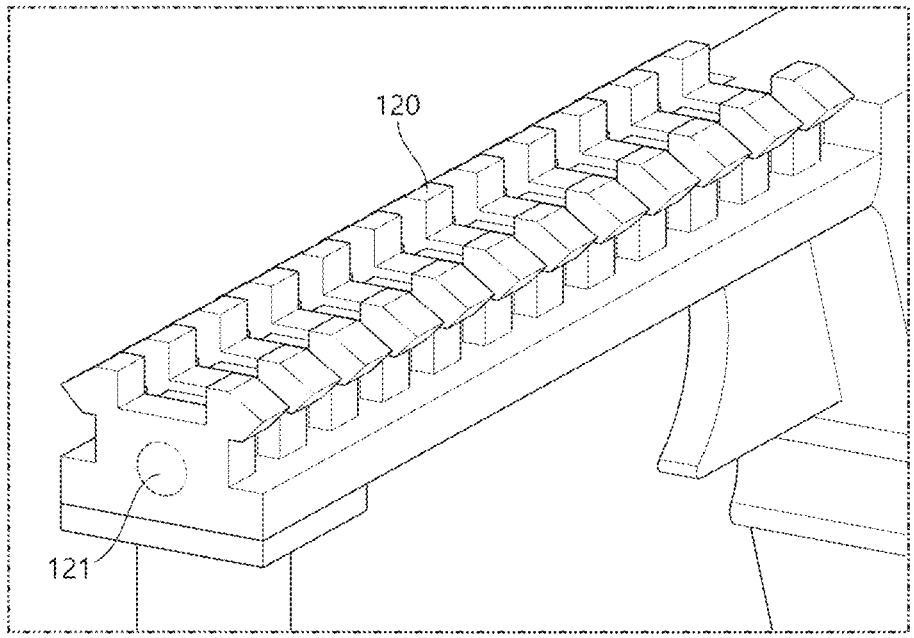
FIG. 6 is a view illustrating a reinforcement iron core 121 provided inside the Picatinny rail 120 and configured to correspond to a length of the Picatinny rail 120.

FIG. 6 is a view illustrating the reinforcement iron core 121 provided inside the Picatinny rail 120 and configured to correspond to a length of the Picatinny rail 120.

With reference to FIG. 6, the reinforcement iron core 121 may be inserted into the Picatinny rail 120 and have a predetermined diameter while corresponding to the length of the Picatinny rail 120. Therefore, the reinforcement iron core may more stably support a structure load during a process of installing various structures, and the reinforcement iron core may also serve to provide high rigidity so that the Picatinny rail 120 is not warped even in the state in which the user grips the support handle 140.

Next, the front sight 180 is provided at a tip of the Picatinny rail 120. The rear sight 190 is provided on an upper portion of the trigger handle 111 of the bullpup-type body part 110 and has a predetermined height difference from the front sight 180. This configuration will be described below.

Figure 7:
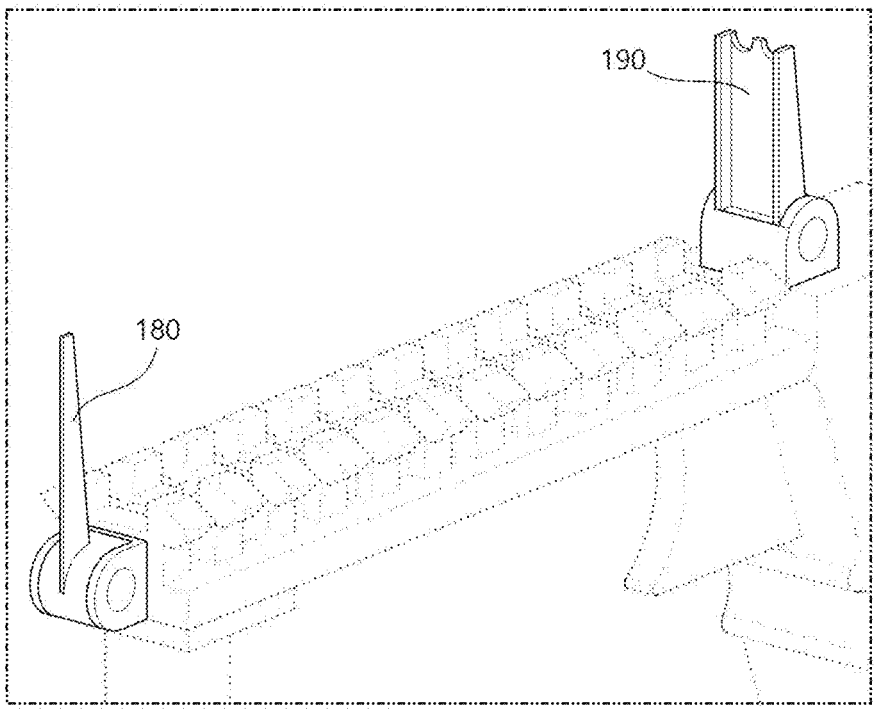
FIG. 7 is a view illustrating a front sight 180 and a rear sight 190.
Figure 8A:
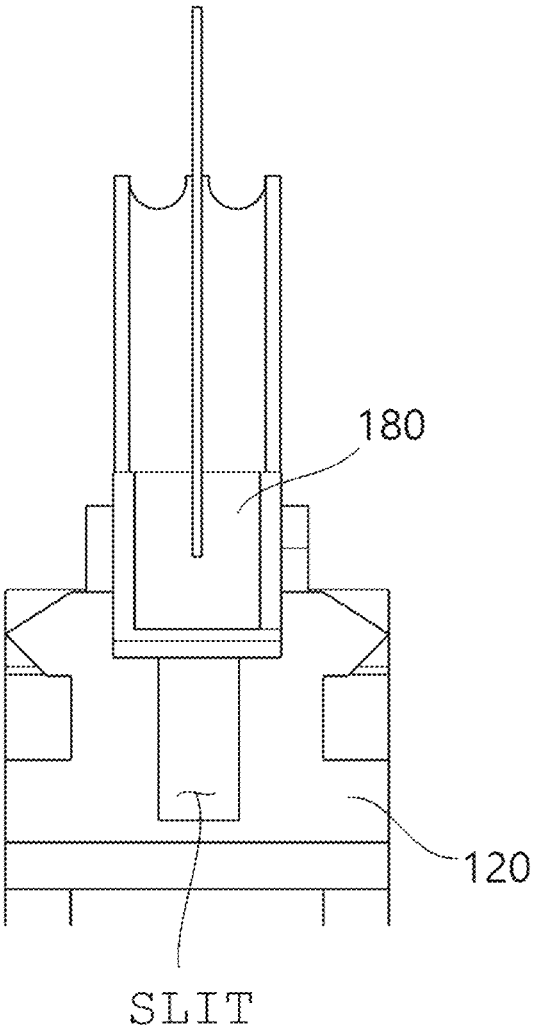
FIGS. 8A and 8B are views illustrating a state in which the front sight 180 is fitted with a tip of the Picatinny rail 120.
Figure 8B:
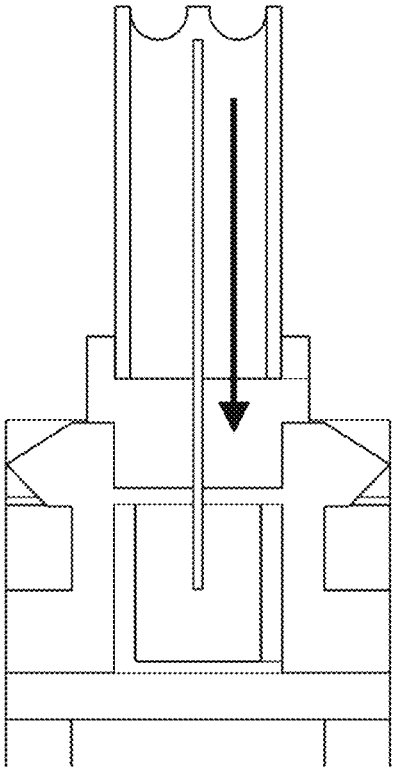
Figure 9:
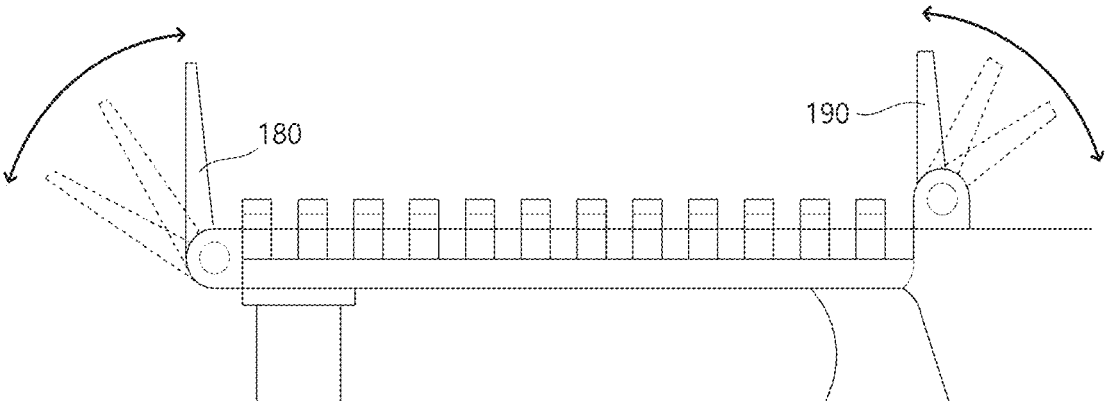
FIG. 9 is a view illustrating a state in which the front sight 180 and the rear sight 190 are rotated so that angles thereof are adjusted.

FIG. 7 is a view illustrating the front sight 180 and the rear sight 190, FIGS. 8A and 8B are views illustrating a state in which the front sight 180 is fitted with the tip of the Picatinny rail 120, and FIG. 9 is a view illustrating a state in which the front sight 180 and the rear sight 190 are rotated so that angles thereof are adjusted.

With reference to FIGS. 7 to 9, the front sight 180 may be fitted with the tip of the Picatinny rail 120 according to the present invention in a direction from above to below. Therefore, the user may conveniently install or separate the front sight 180, as necessary, and more conveniently replace the front sight 180 with a new front sight 180, as necessary.

In addition, an upright state of the front sight 180 is a basic state, and an angle of the front sight 180 is adjusted so that the front sight 180 may be rotated in the upward/downward direction. Therefore, an upright angle of the front sight 180 may be adjusted and used when precise aiming is required.

Meanwhile, the rear sight 190 is provided on the bullpup-type body part 110, particularly, provided above the trigger handle 111. In this case, the rear sight 190 is provided at a higher position than the front sight 180.

This is to solve a problem in which it is not easy to aim because the barrel 130 is positioned below the front sight 180 and the rear sight 190. That is, in general, in case that the barrel 130, the front sight 180, and the rear sight 190 are disposed on the same horizontal line or disposed to be maximally close to horizontality, the front sight 180 and the rear sight 190 need to be disposed at the same position on the same horizontal line if possible. However, in the present invention, because the barrel 130 is disposed at a lowermost portion of the bullpup-type body part 110 to prevent a shell from being bounced and prevent burns or injuries to the user caused by the bounced shell, a height difference is defined between the front sight 180 and the rear sight 190 to correspond to the above-mentioned configuration.

Like the front sight 180, an upright state of the rear sight 190 is also a basic state, and an angle of the rear sight 190 is adjusted so that the rear sight 190 may be rotated in the upward/downward direction. Therefore, an upright angle of the rear sight 190 may be adjusted and used when precise aiming is required.

Next, an embodiment will be described in which various structures (an angle handle and a grenade launcher) are coupled to the Picatinny rail 120 and used in the case of a shape in which a length of the Picatinny rail 120 is further increased.

Figure 10:
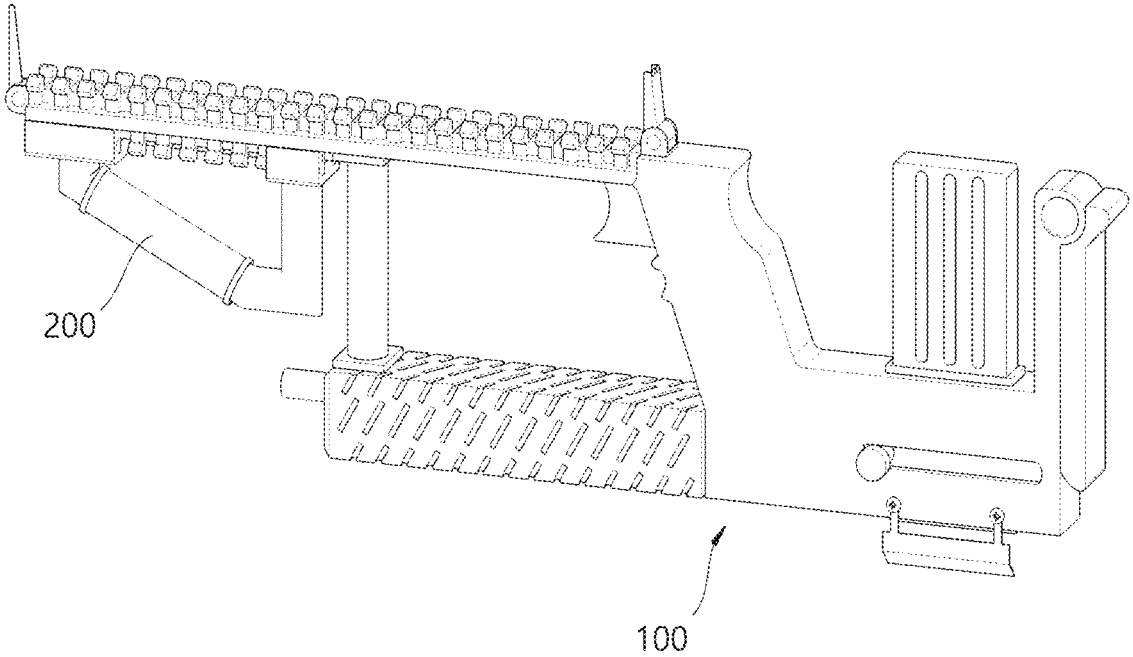
FIG. 10 is a view illustrating an embodiment in which an angle handle 200 is installed below the extended Picatinny rail 120.
Figure 11:
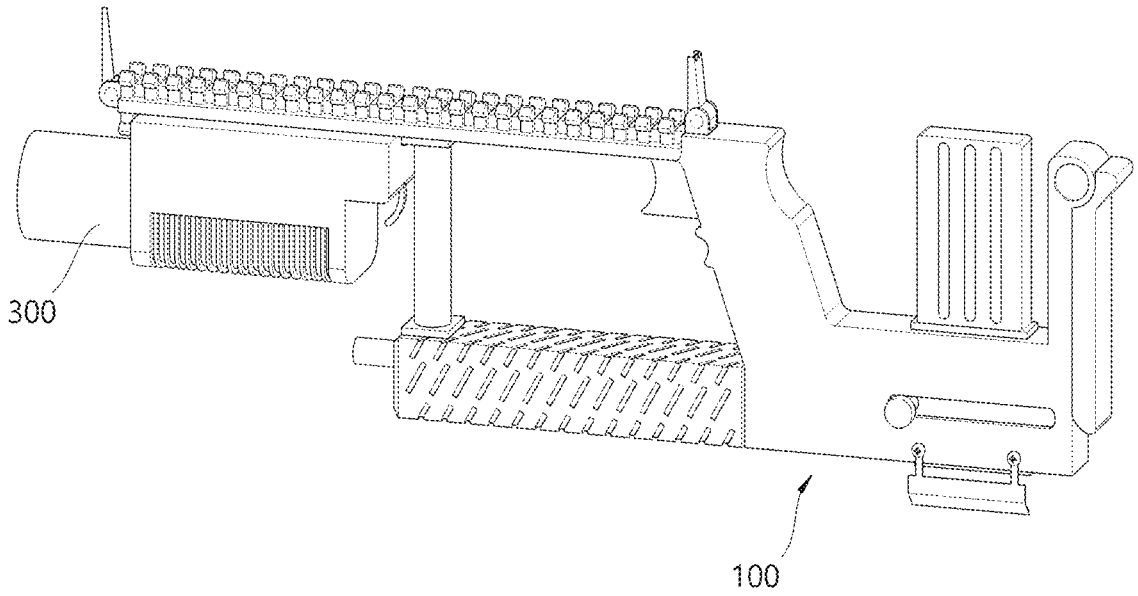
FIG. 11 is a view illustrating an embodiment in which a grenade launcher 300 is installed below the extended Picatinny rail 120.

FIG. 10 is a view illustrating an embodiment in which an angle handle 200 is installed below the extended Picatinny rail 120, and FIG. 11 is a view illustrating an embodiment in which a grenade launcher 300 is installed below the extended Picatinny rail 120.

With reference to FIG. 10, the angle handle 200, which is bent multiple times at predetermined angles, may be installed on the Picatinny rail 120 according to the present invention in addition to the support handle 140. In this case, a binding device (not illustrated) may be provided on the angle handle 200 and detachably coupled to the Picatinny rail 120. Therefore, the user may easily and conveniently couple the angle handle 200 only by slidingly binding the angle handle 200 to the end of the Picatinny rail 120 in a longitudinal direction. Because the user may grip the angle handle 200 in a state in which the user's wrist is bent at a smaller angle in comparison with the support handle 140, the user may feel less wrist strain and fatigue even though the user grips the gun over a long period of time.

With reference to FIG. 11, the grenade launcher 300 may be installed below the Picatinny rail 120 according to the present invention.

Likewise, a binding device (not illustrated) may also be provided on the grenade launcher 300 and detachably coupled to the Picatinny rail 120. Therefore, the user may easily and conveniently couple the grenade launcher 300 only by slidingly binding the grenade launcher 300 to the end of the Picatinny rail 120 in the longitudinal direction.

In addition, any structure may be slidingly bound to the end of the Picatinny rail 120 in the longitudinal direction as long as the structure is interchangeable with the Picatinny rail 120.

While the present invention has been described above with reference to the exemplary embodiments, it may be understood by those skilled in the art that the present invention may be variously modified and changed without departing from the spirit and scope of the present invention disclosed in the claims.

What is claimed is:

1. A bullpup gun with a barrel positioned at the bottom, the bullpup gun comprising: a bullpup body part (110) comprising a trigger handle (111) and a trigger (112); a Picatinny rail (120) provided at an upper tip of the bullpup body part (110) and having a predetermined length defined forward; a barrel (130) provided at a lower tip of the bullpup body part (110) and directed forward; a support handle (140) configured to connect a lower side of a tip of the Picatinny rail (120) and an upper side of a tip of the barrel (130); a magazine (150) inserted and mounted into a rear end of the bullpup body part (110) vertically; a shell reflection plate (160) provided on a lateral surface of the bullpup body part (110) in a downward direction and configured to prevent a shell, which is discharged downward from the bullpup body part (110) after firing, from being bounced upward; and a loading handle (170) disposed below the bullpup body part (110) and disposed at the same horizontal position as the barrel (130).

2. The bullpup gun of claim 1, wherein a buttstock (113) is provided at a rear end of the bullpup body part (110) and unfolded or folded by being rotated from the bullpup body part (110) in an upward/downward direction by means of a hinge.

3. The bullpup gun of claim 1, wherein a reinforcement iron core (121) corresponding to a length of the Picatinny rail (120) is provided inside the Picatinny rail (120).

4. The bullpup gun of claim 1, wherein a front sight (180) is fitted with a tip of the Picatinny rail (120) in a direction from above to below, and a rear sight (190) is provided on an upper portion of the trigger handle (111) and has a height difference from the front sight (180).

5. The bullpup gun of claim 4, wherein the front sight (180) and rear sight (190) are rotated in a hinged manner so that angles thereof are adjusted.

* * * * *